US011724869B2

(12) United States Patent
Klaassen et al.

(10) Patent No.: US 11,724,869 B2
(45) Date of Patent: Aug. 15, 2023

(54) SHIPPING ENVELOPE AND METHOD

(71) Applicant: DAKLAPACK EUROPE B.V., Lelystad (NL)

(72) Inventors: Dave Willem Klaassen, Ermelo (NL); Sander Jan Van Ruitenbeek, Amsterdam (NL)

(73) Assignee: DAKLAPACK EUROPE B.V., Lelystad (NL)

( * ) Notice: Subject to any disclaimer, the term of this patent is extended or adjusted under 35 U.S.C. 154(b) by 866 days.

(21) Appl. No.: 16/478,729

(22) PCT Filed: Jan. 17, 2018

(86) PCT No.: PCT/NL2018/050033
§ 371 (c)(1),
(2) Date: Jul. 17, 2019

(87) PCT Pub. No.: WO2018/135942
PCT Pub. Date: Jul. 26, 2018

(65) Prior Publication Data

US 2019/0329958 A1 Oct. 31, 2019

(30) Foreign Application Priority Data

Jan. 18, 2017 (NL) ..... 2018192

(51) Int. Cl.
*B65D 27/06* (2006.01)
*B65D 81/20* (2006.01)
(Continued)

(52) U.S. Cl.
CPC ..... *B65D 81/2023* (2013.01); *B65D 27/06* (2013.01); *B65D 27/16* (2013.01);
(Continued)

(58) Field of Classification Search
CPC ..... B65D 81/2023; B65D 81/2038; B65D 27/06; B65D 27/16; B65D 27/20;
(Continued)

(56) References Cited

U.S. PATENT DOCUMENTS 3,416,199 A 12/1968 Imamura
5,950,916 A * 9/1999 Santangelo ..... B65D 27/06 229/301

(Continued)

FOREIGN PATENT DOCUMENTS

DE 20 2015 103 839 U1 7/2015

OTHER PUBLICATIONS

International Search Report, issued in PCT/NL2018/050033, dated Mar. 22, 2018.

(Continued)

*Primary Examiner* — Peter N Helvey
(74) *Attorney, Agent, or Firm* — Birch, Stewart, Kolasch & Birch, LLP

(57) ABSTRACT

A plastic shipping envelope includes a first plastic sheet and a second plastic sheet, bonded to each other at a bottom edge and at side edges thereof, wherein a chamber is present between inner sides of the first and second plastic sheets, and wherein an access opening is provided at a top side of the shipping envelope, a resealable airtight seal with interlocking sealing strips, one of the interlocking sealing strips being arranged on the inside of the first sheet and the other of the interlocking sealing strips being arranged on the inside of the second sheet, both sealing strips being arranged near the access opening, in a direction transverse to the side edges, and a one-way air valve, fluidly connecting the chamber of the shipping envelope to the outside, such that air can be vacated, when the chamber is closed by sealing the airtight seal, from the chamber to the outside, wherein the first sheet (Continued)

Figure 1:
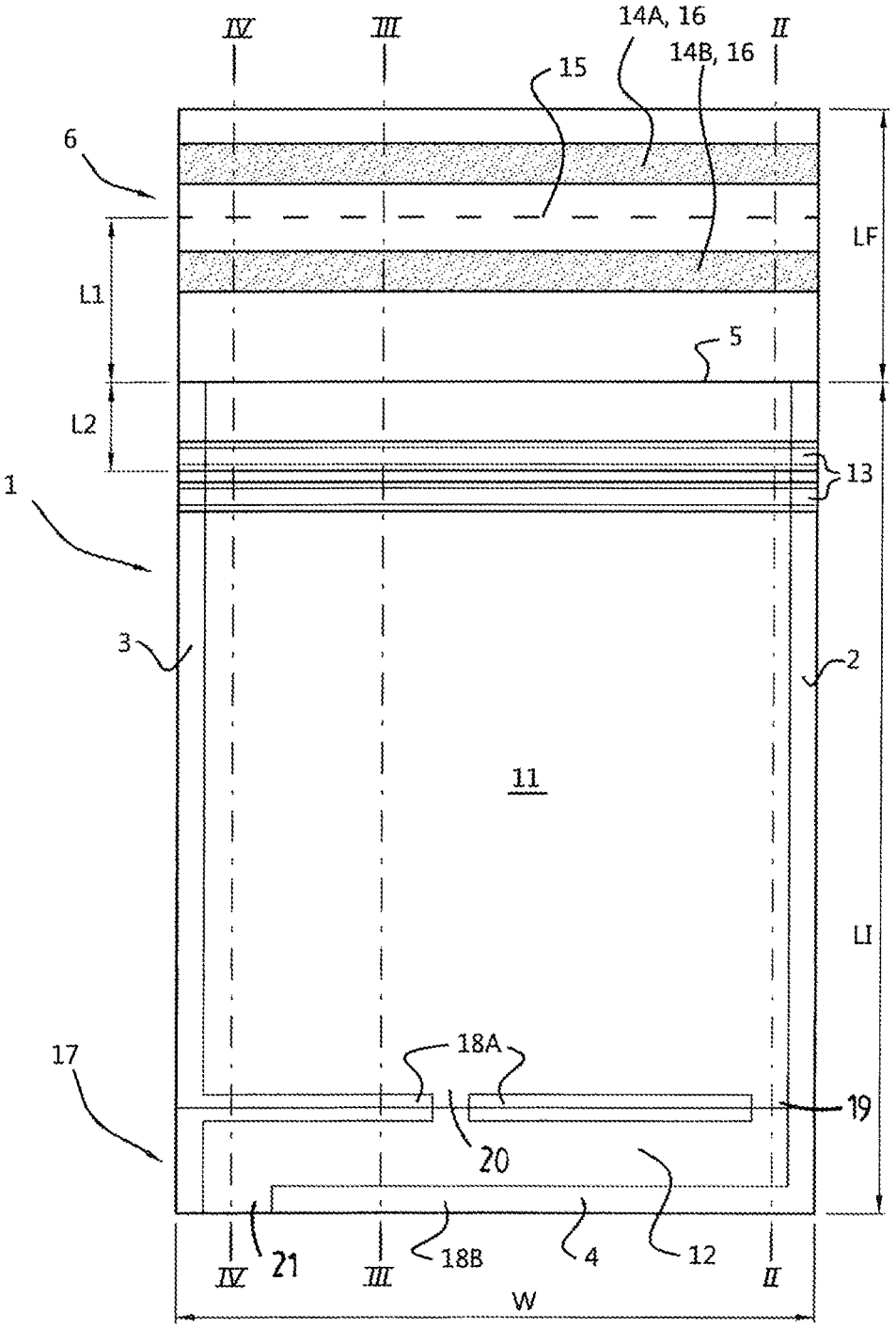

has a flap portion that, with respect to the second sheet, extends beyond the top edge of the second sheet, wherein the flap portion of the first sheet is provided with two vertically spaced apart strips of adhesive material, each arranged in a direction transverse to the side edges, each strip of adhesive material being covered, at its side facing away from the flap portion, by a respective user removable backing, and wherein the flap portion is provided with a perforated tear line, arranged in between the strips of adhesive material.

15 Claims, 4 Drawing Sheets

(51) Int. Cl.

| | |
|---|---|
| ***B65D 27/16*** | (2006.01) |
| ***B65D 27/20*** | (2006.01) |
| ***B65D 27/34*** | (2006.01) |
| ***B65D 33/25*** | (2006.01) |
| ***B65D 85/18*** | (2006.01) |

(52) U.S. Cl.
CPC ..... *B65D 27/20* (2013.01); *B65D 27/34* (2013.01); *B65D 33/2508* (2013.01); *B65D 81/2038* (2013.01); *B65D 85/182* (2013.01); *B65D 2251/20* (2013.01)

(58) Field of Classification Search
CPC .. B65D 27/34; B65D 33/2508; B65D 85/182; B65D 2251/20
USPC ..... 383/203, 86; 229/301, 307, 313
See application file for complete search history.

(56) References Cited

U.S. PATENT DOCUMENTS

| | | | | |
|---|---|---|---|---|
| 6,059,457 | A | 5/2000 | Sprehe et al. | |
| 6,149,302 | A * | 11/2000 | Taheri | B65D 33/2541 383/203 |
| 7,886,412 | B2 * | 2/2011 | Dais | B65D 81/2023 24/585.12 |
| 9,511,911 | B1 * | 12/2016 | Chang | B65D 33/001 |
| 10,106,297 | B2 * | 10/2018 | Chang | B65D 75/5805 |
| 2004/0057636 | A1 | 3/2004 | Ishizaki | |
| 2005/0173506 | A1 * | 8/2005 | Bartlett | B65D 27/14 229/80 |
| 2005/0252816 | A1 | 11/2005 | Ootsubo | |
| 2005/0271307 | A1 | 12/2005 | Pawloski et al. | |
| 2006/0072859 | A1 * | 4/2006 | Melchoir | B65D 33/2541 383/203 |
| 2006/0120631 | A1 | 6/2006 | Tang | |
| 2010/0300919 | A1 | 12/2010 | Alipour | |
| 2011/0311167 | A1 | 12/2011 | Hall | |

OTHER PUBLICATIONS

Written Opinion of the International Searching Authority, issued in PCT/NL2018/050033, dated Mar. 22, 2018.

* cited by examiner

SHIPPING ENVELOPE AND METHOD

The present invention relates to a plastic shipping envelope, comprising a first plastic sheet and a second plastic sheet, bonded to each other at a bottom edge of the shipping envelope and at side edges of the shipping envelope, wherein a chamber is present between inner sides of said first and second plastic sheets, and wherein an access opening is provided at a top side of the shipping envelope to allow one or more items to be inserted in and retrieved from said chamber.

It is an object of the present invention to provide an envelope that can be used to ship one or more items, e.g. items of clothing, household textile, or other elastically compressible items, in an efficient and reliable manner.

Therefore, a plastic shipping envelope is provided according to claim 1.

In use, a sender of the envelope, for example a warehouse of a store, e.g. in the course of an internet sale process, can insert one or more items, for example one or more clothing articles, in the chamber of the envelope. The sender can then close the re-sealable airtight seal, and remove excess air from the chamber, through the one-way valve, to the outside of the envelope by compressing the chamber. The internal volume of the chamber is then reduced and a relative vacuum arises in the chamber of the envelope. In common wording, one may say that the enveloped is vacuumed, although there will typically be some air left in the chamber, such that a pure vacuum, in the technical meaning of the word, is not achieved. When the external volume of the envelope is satisfactorily reduced, or earlier, the sender can remove the backing of the upper of the two strips of adhesive material, and fold the flap portion of the first sheet, along an imaginary line substantially transverse to the side edges of the envelope, such that the upper of the strips of adhesive material adheres to an outer side of the second sheet. Subsequently, the sender can post the envelope. The envelope preferably fits through a letterbox, such that the envelope, and the one or more items inserted in the envelope, is not processed as a parcel but as a letter.

In the Netherlands, the maximum allowed height of an envelope to be processed as a letter is 32 mm, the maximum length of an envelope is 380 mm, and the maximum width is 265 mm. In other countries, these dimensions may be different, and the size of the envelope is not limited to these dimension.

It is noted that throughout this text, with 'letterbox', the British-English equivalent word of the American-English word 'mailbox' is meant.

After delivery of the envelope at the address of the recipient, the recipient can rupture the perforated tear line, open the envelop by unsealing the re-sealable airtight seal, and retrieve the one or more items inserted in the envelope.

The envelope according to the invention can then be used a second time, e.g. when the recipient decides, for whatever reason, that an item is to be returned to the sender, the envelope according to the invention can be used for this return shipment. To send one or more of the received items back, the recipient inserts said item(s) in the chamber of the envelope, through the access opening of the envelope. The recipient can then close the re-sealable airtight seal, and remove excess air from the chamber, through the one-way valve, to the outside of the envelope by compressing the chamber. The internal volume of the air is then reduced and a relative vacuum arises in the chamber of the envelope. When the external volume of the envelope is satisfactorily reduced, or earlier, the recipient can remove the backing of the remaining/second of the two strips of adhesive material, and fold the flap portion of the first sheet, along an imaginary line substantially transverse to the side edges of the envelope, such that the remaining/second of the strips of adhesive material adheres to an outer side of the second sheet. Subsequently, the recipient can post the envelope, wherein the envelope preferably is reduced to a size that fits through a letterbox, such that the envelope, and the one or more items inserted in the envelope, is not processed as a parcel but as a letter.

An advantage of the envelope according to the invention is thus that the external volume of the envelope can reduced, by bringing the chamber of the envelope to a relative vacuum, allowing one or more items, such as one or more textile clothing articles, for example shirts, trousers, t-shirts, socks, leggings, scarfs, shawls, etc. that would normally be shipped via a parcel carrier because the items do not fit through a letterbox, to be shipped via a letterbox.

This volume reduction of the envelope according to the invention results, firstly, in a more efficient handling process for the postal service processing the shipment.

Secondly, this volume reduction of the envelope according to the invention reduces the amount of traffic because, effectively, vans of the postal service transport less air and can transport more postal items in a single ride.

Thirdly, this volume reduction of the envelope according to the invention removes the hassle, experienced by recipients of parcels, of picking up parcels at the neighbour, as their parcel now fits through the letterbox.

Fourthly, sending an item in an envelope that fits through a letterbox and is more cost-efficient for the sender of the item than sending it as a parcel.

The envelope according to the invention is however not limited to the above application. Although it is advantageously used for the shipment of one or more items that can be reduced in volume by compressing them, for example clothing articles, via a letterbox, the envelope according to the invention can beneficially also be used to reduce the size of a parcel, where the smaller parcel does not fit through a letterbox but should still be processed as a parcel by the postal carrier.

A further advantage of the envelope according to the invention, compared to prior-art solutions, is that the sheets which define the chamber of the envelope, define the envelope itself, i.e. define the carrying means. It is specifically noted that, with the envelope according to the invention, it is not needed to place the envelope in an external carrier, such as a cardboard box, before it can be posted. The envelope itself can serve as the outermost layer of the postal item.

A further advantage of the envelope according to the invention, it that it can be used twice. The recipient of the one or more items can use the same envelope to return the shipment, when deemed necessary. This has the potential to reduce waste material as a result of parcel shipping by a factor of two, i.e. to reduce the amount of envelopes/shipping means by a factor of two.

A further advantage of the envelope according to the invention is that the perforated tear line acts as tamper evidence. Upon receiving the envelope, the recipient can easily inspect whether the perforated tear line is still intact, and, thus, if the envelope has been tampered with. If the envelope has been tampered with, receipt of the one or more received items can be rejected.

A further advantage of providing an envelope according to the invention with a flap portion that, in use, covers the access opening of the envelope, is that, when the airtight seal is accidentally unsealed, the one or more items inserted in the envelope are prevented from being displaced out of the envelope by the flap. While the benefit of reduced volume is lost when the airtight seal is accidentally unsealed, the shipment, i.e. the one or more shipped items, is, beneficially, not lost.

A further advantage is that an envelope filled with one or more textile clothing items, by applying a near vacuum, becomes stiffer. This stiffer envelope is processed more easily by an automated envelope processing machine during the postal handling process.

The re-sealable airtight seal with interlocking sealing strips, as arranged on the inner side of the envelope is known per se, can be any readily available re-sealable airtight seal. For example, the airtight seal can comprise a male and a female strip, wherein one of the female and the male strips is arranged on the inner side of the first or the second sheet, while the other of the male and the female strips is arranged on the inner side of the other of the first and the second sheet, opposite of the other of the strips, such that the male and the female strips can be interlocked. Purely by means of example, the sealing strip of U.S. Pat. No. 3,416,199 could be used, although many alternative airtight sealing strips are known per se.

The first sheet of the envelope has a flap portion. This flap portion is defined as the part of the first sheet that extends with respect to the second sheet. In other words: the first and second sheet have a different length.

It is noted that the flap portion comprises two strips of adhesive material. These two strips are spaced apart from each other and both strips are covered, initially, by a respective user-removable backing, much like how the adhesive part of a plaster is, initially, covered by a backing. When using the envelope for the first, initial, shipment, only one of the strips of adhesive material is used to cover the access opening of the envelope and to close it: the upper of the two. The other, lower, strip thus remains covered by its backing. When the envelope is returned, or shipped for the second time, the backing is removed from the second strip of adhesive material and said second strip is adhered to the outer side of the second sheet, covering both the access opening of the envelope and the opening that results from tearing the perforated tear line apart.

The strips of adhesive material are arranged in a direction transverse to the side edges. They can for example be parallel to the bottom of the envelope, but it is also conceivable that they are arranged in a zig-zag pattern, that their shape is (slightly) curved, or that they have another shape, such as a, straight, curved, or discontinuous shape.

Preferably, once the envelope is send for the first time, the adhesion between the adhesive strip and the second sheet is permanent, by which it is meant that it is not possible to remove the flap portion from the second sheet without damaging, for example without tearing, the envelope. The adhesive strength of the adhesive material is thus preferably stronger than the inherent strength of the plastic sheet material.

It is noted that the perforated tear line is arranged with the intention to introduce a weakened line in the flap portion, where it is intended to open the envelope at that perforated tear line after the first, initial, shipment has been delivered/received. This opening of the envelope can for example be achieved by fiddling or (carefully) tearing the perforated tear line open.

According to a preferred embodiment of the invention, the distance between the upper of the strips of adhesive material and the edge of the access opening is larger than the distance between the edge of the access opening and the re-sealable airtight seal. When the flap portion of the first sheet is then folded over the second sheet, the upper of the strips of adhesive material adheres to the second sheet at a location in between the bottom of the envelope and the airtight seal. This improves the tamper evident measure, as it is now difficult to open the envelope without damaging/opening the perforated tear line.

According to a preferred embodiment of the invention, the distance between the edge of the access opening and the perforated tear line is substantially equal to the distance between the edge of the access opening and the re-sealable airtight seal. When the flap portion of the first sheet is then folded over the second sheet, the perforated tear line is arranged substantially on top of the airtight seal. This makes it relatively easy for the recipient of the envelope to retrieve the one or more shipped items from the envelope.

According to a preferred embodiment of the invention, the envelope comprises two airtight seals near the access opening, wherein the first sheet is provided with a first male sealing strip and a first female sealing strip at its inner side, and wherein the second sheet is provided at its inner side with a second female sealing strip, coupled to said first male sealing strip provided on the first sheet, and wherein the second sheet is further provided at its inner side with a second male sealing strip, coupled to said first female sealing strip provided on the first sheet. A double sealing is, advantageously, more secure that a single sealing, leading to an improved airtight seal.

According to a preferred embodiment of the invention, the one-way air valve is arranged along an edge of the envelope, e.g. along the bottom edge, wherein the one-way air valve comprises a first and a second foil, each foil having an inner and outer edge, the first and second foil being arranged substantially parallel to one another and in between the first and the second sheet, the inner edge of the first and second foil being bonded to one another and to the respective first and second sheet, except for at least one port, preferably two spaced apart ports, where the first foil is only bonded to the first sheet and the second foil is only bonded to the second sheet, the outer edge of the first and second foil being bonded to each other and to the inner sides of the first and second sheet along said edge of the envelope except for a port, where said first and second sheet and said first and second foil are all loose from one another, the first and second foil generally being spaced apart from each other when the air valve is opened and the first and second foil being stuck onto one another when the air valve is closed. The use of two foils improves the working of the one-way air valve, compared to a single foil. Although the use of two foils makes it somewhat harder for a user of the envelope to vacate air from the chamber of the envelope, the use of two foils enhances the closure of the valve, when closed.

Alternatively, any other one-way air valve may be used, for example a one-way air valve with one foil. Many other one-way air valve are readily known.

In one embodiment of the invention, the airtight seal strip is closed, wherein the chamber of the envelope comprises one or more items and has been substantially vacated of air, wherein the removable backing has been removed from the upper of the strips of adhesive material, wherein the flap portion of the first sheet is folded over the second sheet, along an imaginary axis transverse to the side edge of the envelope, the flap covering the access opening, and wherein the upper of the strips of adhesive material adheres to an outer side of the second sheet, preferably between the bottom of the envelope and the airtight seal.

This embodiment may be referred to as the 'first shipment state', i.e. the state of the envelope where the envelope can be send, by the sender, to the intended recipient.

In one embodiment of the invention, the removable backing has been removed from the upper of the strips of adhesive material, wherein the flap portion of the first sheet is folded over the second sheet, along an imaginary axis transverse to the side edge of the envelope, wherein the upper of the strips of adhesive material adheres to an outer side of the second sheet, and wherein the perforated tear line is torn open. This embodiment may be referred to as the 'received state', where the envelope is received and opened by the recipient. In this received state, the airtight seal may either be open or closed.

In one embodiment of the invention, the removable backing has been removed from the upper of the strips of adhesive material, wherein the flap portion of the first sheet is folded over the second sheet, along an imaginary axis transverse to the side edge of the envelope, wherein the upper of the strips of adhesive material adheres to an outer side of the second sheet, and wherein the perforated tear line is torn open, and wherein the airtight seal strip is closed, wherein the chamber of the envelope comprises one or more items and is substantially vacated of air, wherein the removable backing is removed from the lower of the strips of adhesive material, and wherein the lower of the strips of adhesive material adheres to an outer side of the second sheet. This embodiment may be referred to as the 'second shipment state', where the envelope can be shipped for the second time, i.e. the return shipment, by the recipient to the original sender of the envelope, or, alternatively, to a further recipient.

Preferably, the sheet material of the envelope is thicker than the material of the foils used in the one-way valve.

Preferably, foils used in the one-way valve are made of a relatively flexible material, for example a plastic material, such as low density polyethylene (LDPE). In one specific example, the foil material is made of 0.04 mm thick LDPE, although many other thicknesses and materials are conceivable.

In one embodiment of the envelope according to the invention, the plastic sheets of the envelope are approximately 80-90 micron in thickness, such as 87 micron. The plastic sheets can for example be made of a laminated plastic material.

The invention further relates to a method of sending one or more items via a postal service, e.g. for sending one or more items, such as clothing or textile articles, via a letterbox, wherein use is made of the plastic shipping envelope according to the invention, the method comprising the steps of:

- optionally, when the re-sealable airtight seal is closed, opening the re-sealable airtight seal of the empty plastic shipping envelope,
- inserting one or more items in the chamber of the shipping envelope,
- closing the airtight seal with the interlocking sealing strips,
- compressing the chamber of the shipping envelope, such that air contained in said chamber is vacated to the outside via the one-way air valve and such that the internal volume of the chamber, containing said one or more items, is reduced, e.g. until the envelope is reduced to a volume that fits through a letterbox,
- removing the backing from the upper of the strips of adhesive material,
- folding the flap of the first sheet along an imaginary axis transverse to the side edges of the envelope, such that the flap covers the access opening,
- adhering the upper of the strips of adhesive material to an outer side of the second sheet of the envelope, preferably between the bottom of the envelope and the airtight seal,
- optionally, applying address information on the envelope, e.g. by applying an address sticker.

The invention further relates to a method for returning, e.g. via a postal service, one or more items that have been received in a plastic shipping envelope according to one or more of the claims 1-8, which items have been removed from the plastic shipping envelope by rupturing the perforated tear line, folding back the flap portion, and opening the airtight seal, wherein the method comprises the steps of:

- inserting one or more items in the chamber of the shipping envelope,
- closing the airtight seal with the interlocking sealing strips,
- compressing the chamber of the shipping envelope, such that air contained in said chamber is vacated to the outside via the one-way air valve and such that the internal volume of the chamber, containing said one or more items, is reduced, e.g. until the envelope is reduced to a volume that fits through a letterbox,
- removing the backing from the remaining of the strips of adhesive material,
- folding the flap of the first sheet along an imaginary axis transverse to the side edges of the envelope, such that the flap covers the access opening,
- adhering the remaining of the strips of adhesive material, directly or indirectly, to an outer side of the second sheet of the envelope
- optionally, applying address information on the envelope, e.g. by applying an address sticker.

The invention further relates to a plastic shipping envelope, comprising:

- a first plastic sheet and a second plastic sheet, bonded to each other at a bottom edge of the shipping envelope and at side edges of the shipping envelope, wherein a chamber is present between inner sides of said first and second plastic sheets, and wherein an access opening is provided at a top side of the shipping envelope to allow one or more items to be inserted in and retrieved from said chamber,
- a re-sealable airtight seal with interlocking sealing strips, one of the interlocking sealing strips being arranged on the inside of the first sheet and the other of the interlocking sealing strips being arranged on the inside of the second sheet, both sealing strips being arranged near the access opening,
- a one-way air valve, fluidly connecting the chamber of the shipping envelope to the outside, such that air can be vacated, when said chamber is closed by sealing said airtight seal, from the chamber to the outside, e.g. by compressing the envelope,
- wherein the one-way air valve is arranged along an edge of the envelope, e.g. along the bottom edge, wherein the one-way air valve comprises a first and a second foil, each foil having an inner and outer edge, the first and second foil being arranged substantially parallel to one another and in between the first and the second sheet, the inner edge of the first and second foil being bonded to one another and to the respective first and second sheet, except for at least one port, preferably two spaced apart ports, where the first foil is only bonded to the first sheet and the second foil is only bonded to the second sheet, the outer edge of the first and second foil being bonded to each other and to the inner sides of the first and second sheet along said edge of the envelope except for a port, where said first and second sheet and said first and second foil are all loose from one another, the first and second foil generally being spaced apart from each other when the air valve is opened and the first and second foil being stuck onto one another when the air valve is closed.

These and other aspects of the invention will be more readily appreciated as the same becomes better understood by reference to the following detailed description and considered in connection with the accompanying drawings in which like reference symbols designate like parts.

Figure 2:
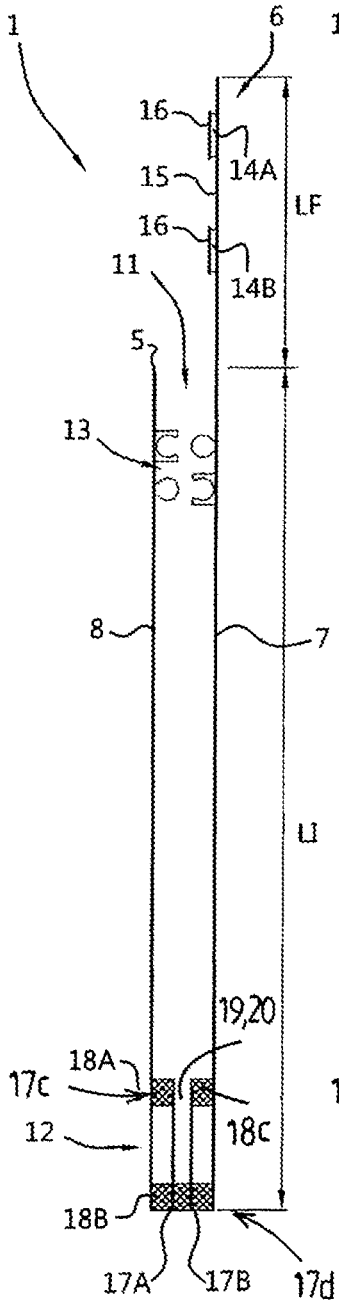
Figure 3:
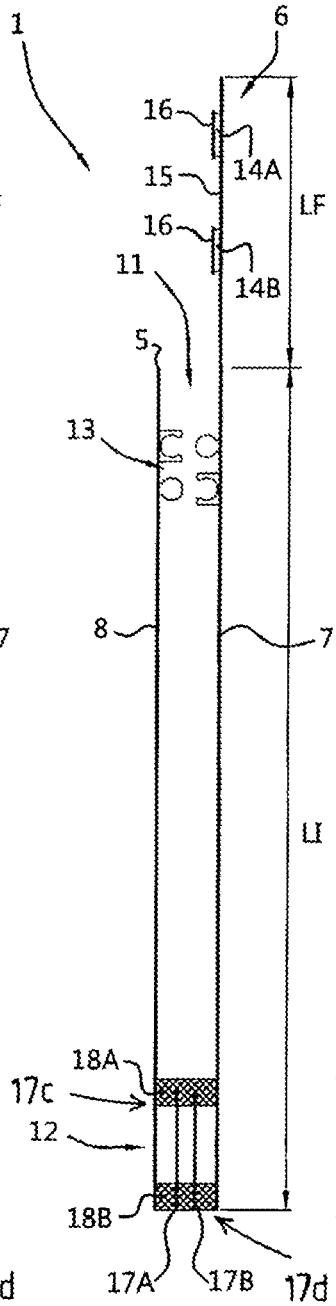
Figure 4:
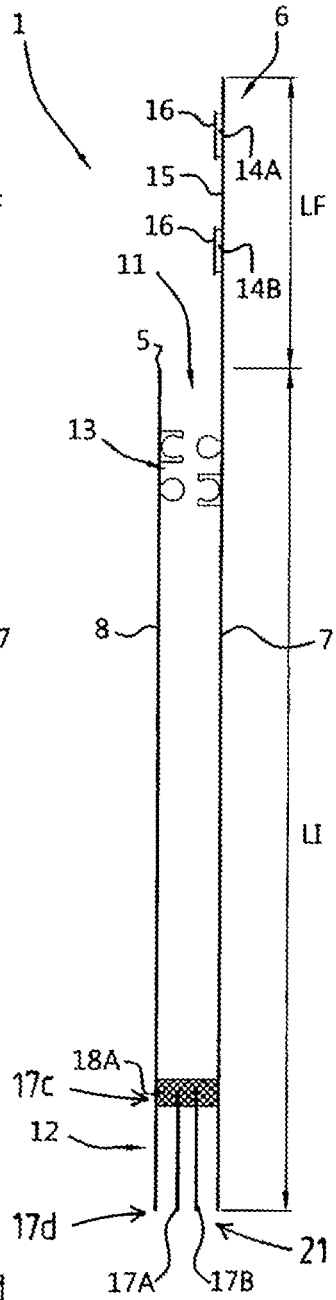
Figure 5:
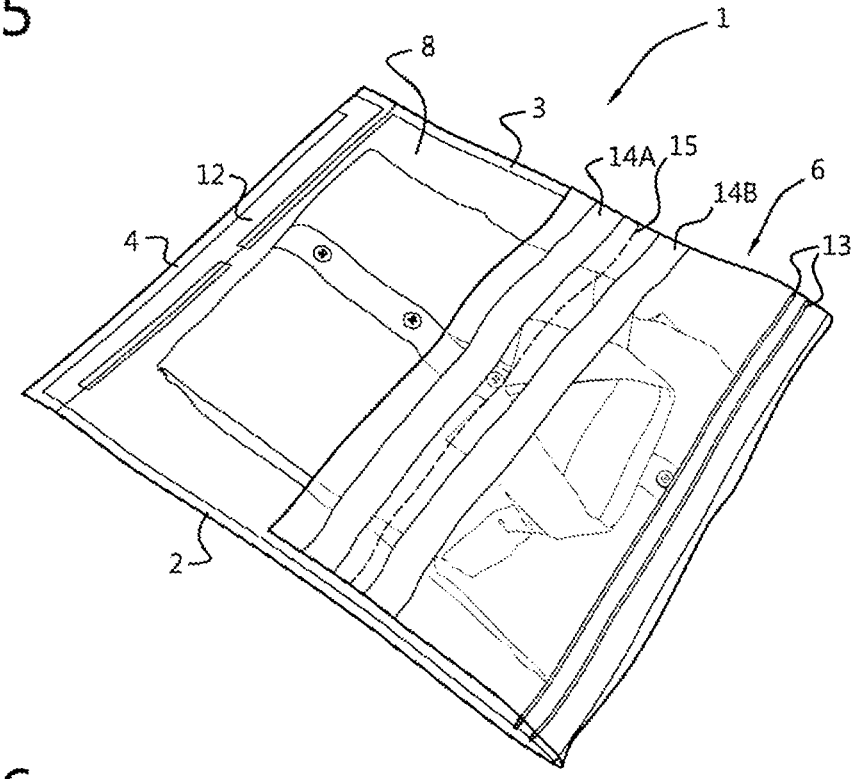
Figure 6:
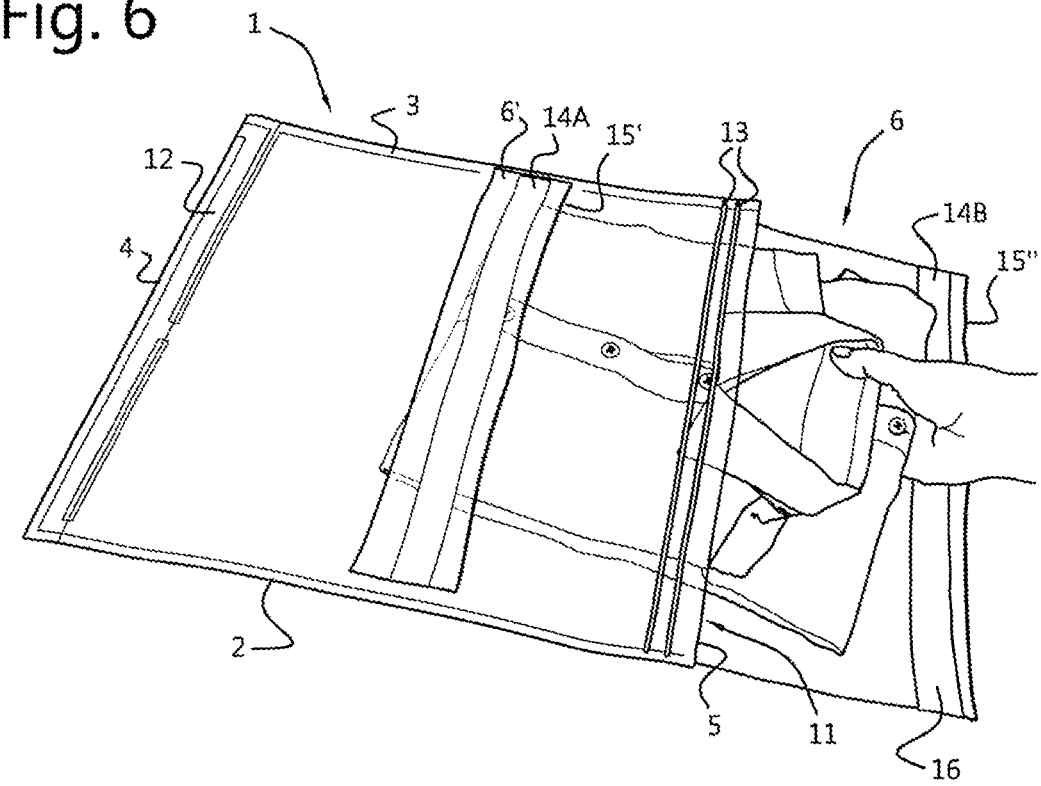
Figure 7:
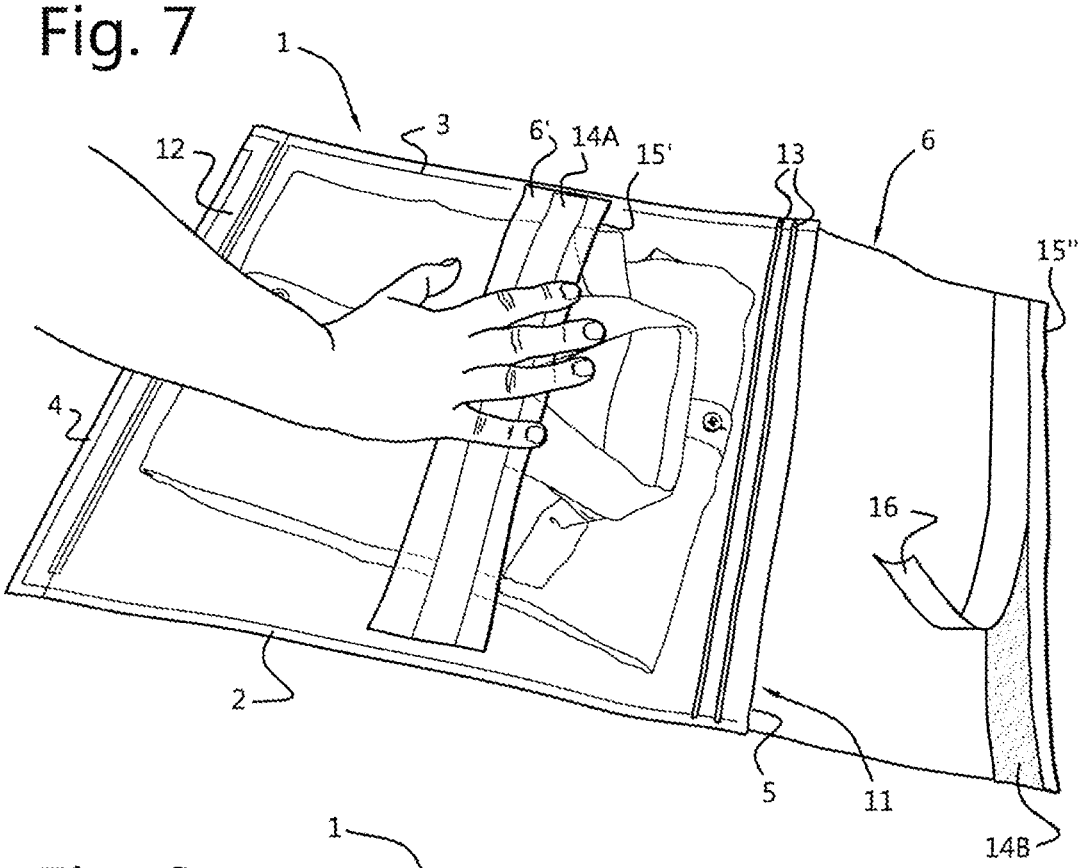
Figure 8:
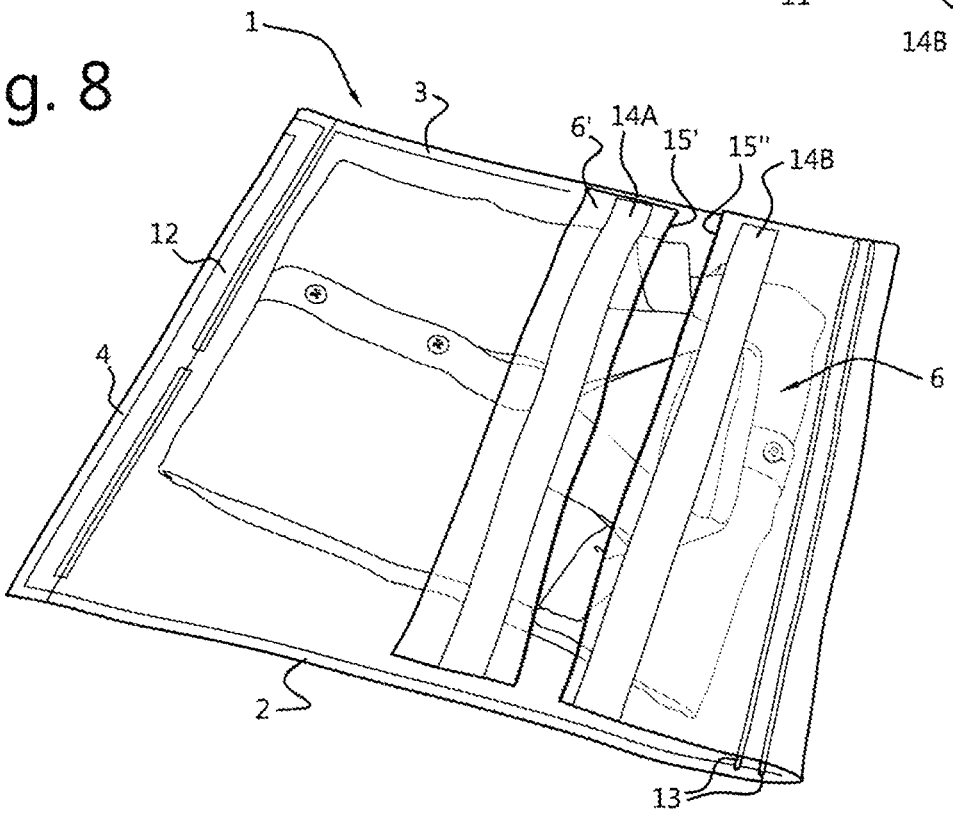

FIG. 1 schematically shows a frontal view of the envelope according to the invention, FIG. 2 schematically shows a cross-sectional view of the envelope according to the invention, along the line II as indicated in FIG. 1, FIG. 3 schematically shows a cross-sectional view of the envelope according to the invention, along the line III as indicated in FIG. 1, FIG. 4 schematically shows a cross-sectional view of the envelope according to the invention, along the line IV as indicated in FIG. 1, FIG. 5 schematically shows a perspective view of the envelope according to the invention, in a first shipment state of the envelope, FIG. 6 schematically shows a perspective view of the envelope according to the invention, in a first received state of the envelope, FIG. 7 schematically shows a perspective view of the envelope according to the invention, in a second received state of the envelope, FIG. 8 schematically shows a perspective view of the envelope according to the invention, in a second shipment state of the envelope.

FIGS. 1-4 show an embodiment of the plastic shipping envelope 1 according to the invention, in an opened, unused state. The envelope comprises a first plastic sheet 7 and a second plastic sheet 7, the sheets 7, 8 being bonded, for example sealed, to each other at a bottom edge 4 of the shipping envelope, and at left 2 and right 3 side edges of the shipping envelope 1. In the specific embodiment of FIGS. 1-4, the envelope has a rectangular shape, but this is not necessary. Alternatively, the envelope may also be square, or at least partially rounded.

A chamber or internal volume 11 is present between inner sides of the first 7 and second 8 plastic sheets, and an access opening is provided at a top side of the shipping envelope, near an upper edge 5 of the second sheet 8, to allow one or more items, for example the shirt visible in FIGS. 5-8, to be inserted in and retrieved from the chamber 11 of the envelope.

The plastic shipping envelope furthermore comprises a re-sealable airtight seal 13 with interlocking sealing strips. In the specific embodiment of the figures, there are two re-sealable airtight seals, wherein one of the interlocking sealing strips of each airtight seal is arranged on the inside of the first sheet 7 and the other of the interlocking sealing strips of each airtight seal is arranged on the inside of the second sheet 8. Both airtight seals 13 are arranged near the access opening, in a direction transverse to the side edges 2, 3 of the envelope. More specifically, the airtight seals 13 are arranged substantially parallel to the bottom 4 of the envelope. For example, the interlocking sealing strips can be male and female strips that interlock, as shown.

In the embodiment of FIGS. 1-4, the envelope comprises two airtight seals 13 near the access opening, wherein the first sheet 7 is provided with a first male sealing strip and a first female sealing strip at its inner side, and wherein the second sheet 8 is provided at its inner side with a second female sealing strip, coupled to said first male sealing strip provided on the first sheet 7, and wherein the second sheet 8 is further provided at its inner side with a second male sealing strip, coupled to said first female sealing strip provided on the first sheet 7.

The plastic shipping envelope according to the invention further comprises a one-way valve 12, fluidly connecting the chamber 11 of the shipping envelope to the outside, such that air can be vacated, when said chamber 11 is closed by sealing said airtight seal 13, from the chamber 11 to the outside via the one-way valve 12, e.g. by compressing the envelope 1.

The one-way valve 12 is arranged along the bottom 4 of the envelope, in the embodiment of the figures, but the one-way air valve 12 can be arranged along any edge 2, 3, 4 of the envelope.

In the embodiment of FIGS. 2-4, the one-way air valve 12 comprises a first 17A and a second 17B foil, each foil 17A, 17B having an inner 17C and outer 17D edge, the first 17A and second 17B foils being arranged along an edge 2, 3, 4 of the envelope, in the embodiment of FIGS. 2-4 along the bottom edge 4. The first 17A and second 17B foil are arranged substantially parallel to one another and in between the first 7 and the second 8 sheet, the inner edges 17C of the first 17A and second 17B foil being bonded to one another and to the respective first 7 and second 8 sheet, except for two spaced apart ports 19, 20. At these two ports 19, 21, the first foil 17A is only bonded to the first sheet 7 with a bonding 18A and the second foil 17B is only bonded to the second sheet 8 with a bonding 18C, but the first 17A and the second 17B foils are not bonded to each other. The outer edges 17D of the first 17A and second 17B foil are further bonded to each other and to the inner sides of the first 7 and second 8 sheet along said bottom 4 of the envelope 1 with a bonding 18B, except for a port 21, where said first 7 and second 8 sheet and said first 17A and second 17B foil are all loose from one another, the first 17A and second 17B foil generally being spaced apart from each other when the air valve 12 is opened, as shown in FIG. 4, and the first 17A and second 17B foil being stuck onto one another when the air valve 12 is closed, not shown in the figures.

It is noted that FIG. 2 shows a schematic cross-sectional view along a vertical line through port 19, but that a schematic cross-sectional view along a vertical line through port 20 is the same.

As visible in FIGS. 1-4, the first sheet 7 has a flap portion 6 that, with respect to the second sheet 8, extends beyond the top edge 5 of said second sheet 8. This flap portion 6 of the first sheet 7 is provided with two vertically spaced apart strips of adhesive material 14A, 14B, each arranged in a direction transverse to the side edges 2, 3, each strip of adhesive material 14A, 14B being covered, in the shown, unused, state, at its side facing away from the flap portion 6, by a respective user-removable backing 16. The flap portion 6 is provided with a perforated tear line 15, arranged in between said strips of adhesive material 14A, 14B.

A distance can be defined between the upper 14A of the strips of adhesive material and the edge 5 of the access opening. In a preferred embodiment of the envelope 1, this distance is larger than the distance between the edge 5 of the access opening and the re-sealable airtight seal 13.

Further, a distance L1 can be defined between the edge 5 of the access opening and the perforated tear line 15. In a preferred embodiment, this distance L1 is substantially equal to or larger than the distance L2 defined between the edge 5 of the access opening and the re-sealable airtight seal 13.

The intended use of the envelope 1 is explained based on FIGS. 5-8. The open, unused state of the plastic shipping envelope 1 is shown in FIGS. 1-4. This envelope can be used to ship one or more items, such as clothing articles, for example shirts, trousers, skirts, t-shirts, jackets, etc. or other resiliently compressible items. Such items, when shipped in for example a regular envelop or in a cardboard box, take up a relatively large volume, due to the excess air trapped between the layers of cloth when the clothing item is folded. Such resiliently compressible items benefit from applying a relative vacuum in the chamber 11 of the envelope, as the volume taken up by the clothing article, and thus the outer dimensions of the envelope, are then reduced.

In FIG. 5, a first shipment state of the envelope 1 is shown. An article, in FIG. 5 a shirt, has been inserted in the chamber 11 of the envelope 1, the chamber 11 of the envelope thus comprising one or more items. The airtight seal 13 of the envelope 1 is sealed and the chamber 11 has been substantially vacated of air, i.e. excess air has been removed from the chamber 11. The removable backing 16 has been removed from the upper 14A of the strips of adhesive material, and the flap portion 6 of the first sheet 7 has been folded over the second sheet 8, along an imaginary axis transverse to the side edges 2, 3 of the envelope 1. The flap portion 6 covers the access opening of the envelope, and the upper 14A of the strips of adhesive material adheres to an outer side of the second sheet 8, between the bottom 4 of the envelope and the airtight seal 13. It is noted that the backing 16 of the second 14B of the strips of adhesive material is still attached to the second 14B of the strips of adhesive material, such that only the upper 14A of the strips of adhesive material adheres to the outer side of the second sheet 8.

In the state of FIG. 5, the plastic shipping envelope can be send from a sender to a recipient, e.g. by providing an address and a stamp on the envelope FIG. 6 shows a state of the plastic shipping envelope wherein the envelope has been delivered to the recipient, where the perforated tear line 15 is ruptured, where the airtight seal 13 is opened, and where the item shipped in the envelope is being removed from the chamber 11. In the state of FIG. 6, the removable backing 16 has been removed from the upper 14A of the strips of adhesive material, and the flap portion 6 is partially folded over the second sheet 8, along an imaginary axis transverse to the side edges 2, 3 of the envelope. The upper 14A of the strips of adhesive material still adheres to an outer side of the second sheet 8, and the perforated tear line 15', 15" is ruptured. A part 6' of the flap portion 6 remains adhered to the outer side of the second sheet 8 after rupture of the tear line 15', 15", due to the adhesive properties of the strip 14A of adhesive material. It is noted that, in the state of the plastic shipping envelope of FIG. 6, as shown, the backing 16 of the second 14B of the strips of adhesive material, still covers said second strip 14B.

FIG. 7 shows a state of the plastic shipping envelope when the envelope is closed again, after it is opened. Evidence that the envelope is opened before, is provided by the part 6' of the flap portion 6 that is adhered to the outer side of the second sheet 8, and by the perforated tear line 15', 15" that has been ruptured. In FIG. 7, the item is inserted in the chamber 11 of the envelope, and the recipient of the envelope is compressing the chamber 11 of the envelope, to vacate excess air from the chamber 11, through the one-way valve 12, to outside of the envelope. As visible, before folding the remaining flap portion 6 for a second time, the backing 16 of the second 14B strip of adhesive material is to be removed.

FIG. 8 shows a state of the plastic shipping envelope where it is ready to be shipped for the second time. As visible, the airtight seal 13 has been closed/sealed, the chamber 11 of the envelope comprises the item to be shipped and has been substantially vacated of air, the removable backing 16 has been removed from the lower 14B of the strips of adhesive material, and this lower 14B of the strips of adhesive material adheres to an outer side of the second sheet 8.

As visible, a small spacing is present between the two parts 6, 6' of the flap portion, where the tear line 15', 15" has been ruptured. The presence of this spacing is not necessary. Alternatively, the second 14B strip of adhesive material may be adhered to the part 6' of the flap portion that is adhered to the second sheet 8, such that there are three layers on top of each other, and such that the remaining flap portion 6 indirectly adheres to the outer side of the second sheet 8.

The invention further relates to a method of sending one or more items via a postal service, e.g. for sending one or more items, such as textile clothing articles, household articles, or other resiliently compressible items, via a letter-box, wherein use is made of a plastic shipping envelope 1 according to the invention, the method comprising the steps of:

- optionally, when the re-sealable airtight seal 13 is closed, opening the re-sealable airtight seal 13 of the empty plastic shipping envelope 1,
- inserting one or more items in the chamber 11 of the shipping envelope 1,
- closing the airtight seal 13 with the interlocking sealing strips,
- compressing the chamber 11 of the shipping envelope 1, such that air contained in said chamber 11 is vacated to the outside via the one-way air valve 12 and such that the internal volume of the chamber 11, containing said one or more items, is reduced, e.g. until the envelope 1 is reduced to a volume that fits through a letterbox,
- removing the backing 16 from the upper 14A of the strips of adhesive material,
- folding the flap 6 of the first sheet 7 along an imaginary axis transverse to the side edges 2, 3 of the envelope 1, such that the flap 6 covers the access opening,
- adhering the upper 14A of the strips of adhesive material to an outer side of the second sheet 8 of the envelope 1, preferably between the bottom 4 of the envelope 1 and the airtight seal 13,
- optionally, applying address information on the envelope 1, e.g. by applying an address sticker The invention further relates to a method for returning, e.g. via a postal service, one or more items that have been received in a plastic shipping envelope 1 according to the invention, which items have been removed from the plastic shipping envelope 1 by rupturing the perforated tear line 15', 15", folding back the flap portion 6, and opening the airtight seal 13, wherein the method comprises the steps of:

inserting one or more items in the chamber 11 of the shipping envelope 1, closing the airtight seal 13 with the interlocking sealing strips, compressing the chamber 11 of the shipping envelope 1, such that air contained in said chamber 11 is vacated to the outside via the one-way air valve 12 and such that the internal volume of the chamber 11, containing said one or more items, is reduced, e.g. until the envelope 1 is reduced to a volume that fits through a letterbox, removing the backing 16 from the remaining 14B of the strips of adhesive material, folding the flap 6 of the first sheet 7 along an imaginary axis transverse to the side edges 2, 3 of the envelope 1, such that the flap 6 covers the access opening, adhering the remaining 14B of the strips of adhesive material, directly or indirectly, to an outer side of the second sheet 8 of the envelope optionally, applying address information on the envelope 1, e.g. by applying an address sticker.

The invention claimed is:

1. A plastic shipping envelope, comprising:

a first plastic sheet and a second plastic sheet, bonded to each other at a bottom edge of the shipping envelope and at side edges of the shipping envelope, wherein a chamber is present between inner sides of said first plastic sheets and said second plastic sheet, and wherein an access opening is provided at a top side of the shipping envelope to allow one or more items to be inserted in and retrieved from said chamber;

a re-sealable airtight seal with interlocking sealing strips, one of the interlocking sealing strips being arranged on the inside of the first sheet and the other of the interlocking sealing strips being arranged on the inside of the second sheet, both sealing strips being arranged near the access opening, in a direction transverse to the side edges; and a one-way air valve, fluidly connecting the chamber of the shipping envelope to the outside, such that air can be vacated, when said chamber is closed by sealing said airtight seal, from the chamber to the outside, wherein the first sheet has a flap portion that, when the flap is in an open position, with respect to the second sheet, extends beyond a top edge of said second sheet, wherein the flap portion, when the flap is in a closed position, is folded onto the second plastic sheet, wherein the flap portion of said first sheet is provided with an upper strip of adhesive material and a lower strip of adhesive material, each of said strips of adhesive material being arranged in a direction transverse to the side edges, and each of said strips of adhesive material being covered, at a side thereof facing away from the flap portion, by a respective user-removable backing, wherein the flap portion is provided with a perforated tear line, arranged in between said upper strip of adhesive material and said lower strip of adhesive material, wherein, when the flap of the envelope is in the open position, the upper strip of adhesive material is at a first distance from the top edge of the second sheet, the perforated tear line is at a second distance from the top edge of the second sheet, and the lower strip of adhesive material is at a third distance from the top edge of the second sheet, the first distance being larger than the second distance and the second distance being larger than the third distance, wherein the airtight seal is at a fourth distance from the top edge of the second sheet, the fourth distance being larger than the third distance and smaller than the first distance, wherein the second distance is equal to the fourth distance, and wherein the air tight seal is positioned between the upper strip of adhesive material and lower strip of adhesive material when the flap is in the closed position.

2. The plastic shipping envelope according to claim 1, wherein the envelope comprises two airtight seals near the access opening, wherein the first sheet is provided with a first male sealing strip and a first female sealing strip at an inner side thereof, and wherein the second sheet is provided at an inner side thereof with a second female sealing strip, coupled to said first male sealing strip provided on the first sheet, and wherein the second sheet is further provided at the inner side with a second male sealing strip, coupled to said first female sealing strip provided on the first sheet.

3. The plastic shipping envelope according to claim 1, wherein the one-way air valve is arranged along an edge of the envelope, wherein the one-way air valve comprises a first and a second foil, each of the first and second foil having an inner and outer edge, the first and second foil being arranged parallel to one another and in between the first and the second sheet, the inner edge of the first and second foil being bonded to one another and to the respective first and second sheet, except for at least one port, where the first foil is only bonded to the first sheet and the second foil is only bonded to the second sheet, the outer edge of the first and second foil being bonded to each other and to the inner sides of the first and second sheet along said edge of the envelope except for a port, where said first and second sheet and said first and second foil are all loose from one another, the first and second foil generally being spaced apart from each other when the air valve is opened and the first and second foil being stuck onto one another when the air valve is closed.

4. The plastic shipping envelope according to claim 3, wherein the one-way air valve is arranged along the bottom edge of the envelope.

5. The plastic shipping envelope according to claim 1, wherein the airtight seal strip is closed, wherein the chamber of the envelope comprises one or more items and has been vacated of air, wherein the removable backing has been removed from the upper strip of adhesive material, wherein the flap portion of the first sheet is folded over the second sheet, along an imaginary axis transverse to the side edge of the envelope, the flap covering the access opening, and wherein the upper strip of adhesive material adheres to an outer side of the second sheet.

6. The plastic shipping envelope according to claim 5, wherein the upper strip of adhesive material adheres to an outer side of the second sheet between the bottom of the envelope and the airtight seal.

7. The plastic shipping envelope according to claim 1, wherein the removable backing has been removed from the upper strip of adhesive material, wherein the flap portion of the first sheet is folded over the second sheet, along an imaginary axis transverse to the side edge of the envelope, wherein the upper strip of adhesive material adheres to an outer side of the second sheet, and wherein the perforated tear line is torn open.

8. The plastic shipping envelope according to claim 7, wherein the airtight seal strip is closed, wherein the chamber of the envelope comprises one or more items and is vacated of air, wherein the removable backing is removed from the lower of the strips of adhesive material, and wherein the lower of the strips of adhesive material adheres to an outer side of the second sheet.

9. A method of sending one or more items via a postal service via a letterbox, comprising the step of using a plastic shipping envelope, the plastic shipping envelope, comprising:

a first plastic sheet and a second plastic sheet, bonded to each other at a bottom edge of the shipping envelope and at side edges of the shipping envelope, wherein a chamber is present between inner sides of said first and second plastic sheets, and wherein an access opening is provided at a top side of the shipping envelope to allow one or more items to be inserted in and retrieved from said chamber;

a re-sealable airtight seal with interlocking sealing strips, one of the interlocking sealing strips being arranged on the inside of the first sheet and the other of the interlocking sealing strips being arranged on the inside of the second sheet, both sealing strips being arranged near the access opening, in a direction transverse to the side edges; and a one-way air valve, fluidly connecting the chamber of the shipping envelope to the outside, such that air can be vacated, when said chamber is closed by sealing said airtight seal, from the chamber to the outside, wherein the first sheet has a flap portion that, with respect to the second sheet, extends beyond the top edge of said second sheet, wherein the flap portion of said first sheet is provided with an upper strip of adhesive material and a lower strip of adhesive material, each of said strips of adhesive material being arranged in a direction transverse to the side edges, each of said strips of adhesive material being covered, at a side thereof facing away from the flap portion, by a respective user-removable backing, and wherein the flap portion is provided with a perforated tear line, arranged in between said strips of adhesive material, the method further comprising the steps of:

inserting one or more items in the chamber of the shipping envelope;

closing the airtight seal with the interlocking sealing strips;

compressing the chamber of the shipping envelope, such that air contained in said chamber is vacated to the outside via the one-way air valve and such that the internal volume of the chamber, containing said one or more items, is reduced;

removing the backing from the upper strip of adhesive material;

folding the flap of the first sheet along an imaginary axis transverse to the side edges of the envelope, such that the flap covers the access opening so that the upper strip of adhesive material is below the airtight seal and the lower strip of adhesive material is above the airtight seal and the perforated tear line overlies the airtight seal; and adhering the upper strip of adhesive material to an outer side of the second sheet of the envelope, preferably between the bottom of the envelope and the airtight seal.

10. The method according to claim 9, the method further comprising the step:

when the re-sealable airtight seal is closed, opening the re-sealable airtight seal of the empty plastic shipping envelope.

11. The method according to claim 9, the method further comprising the step:

applying address information on the envelope.

12. The method according to claim 9, wherein the chamber of the shipping envelope is compressed, such that air contained in said chamber is vacated to the outside via the one-way air valve and such that the internal volume of the chamber, containing said one or more items, is reduced, until the envelope is reduced to a volume that fits through a letterbox.

13. A method for returning one or more items that have been received in a plastic shipping envelope, the plastic shipping envelope comprising:

a first plastic sheet and a second plastic sheet, bonded to each other at a bottom edge of the shipping envelope and at side edges of the shipping envelope, wherein a chamber is present between inner sides of said first and second plastic sheets, and wherein an access opening is provided at a top side of the shipping envelope to allow one or more items to be inserted in and retrieved from said chamber;

a re-sealable airtight seal with interlocking sealing strips, one of the interlocking sealing strips being arranged on the inside of the first sheet and the other of the interlocking sealing strips being arranged on the inside of the second sheet, both sealing strips being arranged near the access opening, in a direction transverse to the side edges; and a one-way air valve, fluidly connecting the chamber of the shipping envelope to the outside, such that air can be vacated, when said chamber is closed by sealing said airtight seal, from the chamber to the outside, wherein the first sheet has a flap portion that, with respect to the second sheet, extends beyond the top edge of said second sheet, wherein the flap portion of said first sheet is provided with upper strip of adhesive material and a lower strip of adhesive material, each of said strips of adhesive material being arranged in a direction transverse to the side edges, each of said strips of adhesive material being covered, at a side thereof facing away from the flap portion, by a respective user-removable backing, and wherein the flap portion is provided with a perforated tear line, arranged in between said strips of adhesive material and overlying the airtight seal, wherein the items have been removed from the plastic shipping envelope by rupturing the perforated tear line, folding back the flap portion, and opening the airtight seal, and wherein the method comprises the steps of:

inserting one or more items in the chamber of the shipping envelope;

closing the airtight seal with the interlocking sealing strips;

compressing the chamber of the shipping envelope, such that air contained in said chamber is vacated to the outside via the one-way air valve and such that the internal volume of the chamber, containing said one or more items, is reduced;

removing the backing from the remaining of the strips of adhesive material;

folding the flap of the first sheet along an imaginary axis transverse to the side edges of the envelope, such that the flap covers the access opening; and adhering the remaining of the strips of adhesive material, directly or indirectly, to an outer side of the second sheet of the envelope so that the upper strip of adhesive material is below the airtight seal and the lower strip of adhesive material is above the airtight seal.

14. The method according to claim 13, the method further comprising the step:

applying address information on the envelope.

15. The method according to claim 13, wherein the chamber of the shipping envelope is compressed, such that air contained in said chamber is vacated to the outside via the one-way air valve and such that the internal volume of the chamber, containing said one or more items, is reduced, until the envelope is reduced to a volume that fits through a letterbox.

* * * * *